US007658644B2

(12) United States Patent
Ahn

(10) Patent No.: US 7,658,644 B2
(45) Date of Patent: Feb. 9, 2010

(54) STRUCTURE OF POWER TERMINAL FOR ABS CONNECTOR

(75) Inventor: Mun Hwan Ahn, Ulsan-Si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/276,628

(22) Filed: Nov. 24, 2008

(65) Prior Publication Data

US 2009/0156039 A1 Jun. 18, 2009

(30) Foreign Application Priority Data

Dec. 12, 2007 (KR) ..... 10-2007-0129240

(51) Int. Cl.
*H01R 13/40* (2006.01)

(52) U.S. Cl. ..... 439/587

(58) Field of Classification Search ..... 439/271–275, 439/587, 588, 589
See application file for complete search history.

(56) References Cited

U.S. PATENT DOCUMENTS

| | | | | |
|---|---|---|---|---|
| 5,607,318 | A * | 3/1997 | Wakata et al. | 439/274 |
| 5,611,706 | A * | 3/1997 | Makita et al. | 439/275 |
| 5,718,596 | A * | 2/1998 | Inaba et al. | 439/352 |
| 6,186,829 | B1 * | 2/2001 | Murakami et al. | 439/587 |
| 6,361,378 | B1 * | 3/2002 | Konoya et al. | 439/752 |
| 6,582,242 | B2 * | 6/2003 | Murakami et al. | 439/271 |
| 6,709,282 | B2 * | 3/2004 | Sugiyama | 439/275 |
| 6,894,224 | B2 * | 5/2005 | Kobayashi et al. | 174/74 R |
| 6,953,365 | B2 * | 10/2005 | Tabata et al. | 439/587 |
| 7,033,215 | B2 * | 4/2006 | Kobayashi | 439/587 |
| 7,104,831 | B2 * | 9/2006 | Fukatsu et al. | 439/385 |
| 7,114,983 | B2 * | 10/2006 | Fukatsu et al. | 439/358 |
| 7,211,731 | B2 * | 5/2007 | Nagamine et al. | 174/74 R |
| 7,311,546 | B2 * | 12/2007 | Itou | 439/385 |
| 7,419,395 | B2 * | 9/2008 | Tsuji et al. | 439/271 |
| 7,448,894 | B2 * | 11/2008 | Tsuji et al. | 439/271 |
| 7,481,665 | B2 * | 1/2009 | Hiramatsu | 439/385 |
| 7,553,186 | B2 * | 6/2009 | Morikawa et al. | 439/587 |
| 2001/0049226 | A1 * | 12/2001 | Murakami et al. | 439/587 |
| 2002/0028603 | A1 * | 3/2002 | Murakami et al. | 439/589 |
| 2003/0027454 | A1 * | 2/2003 | Sugiyama | 439/588 |
| 2003/0157832 | A1 * | 8/2003 | Tabata | 439/587 |
| 2004/0171304 | A1 * | 9/2004 | Tabata et al. | 439/587 |
| 2005/0221672 | A1 * | 10/2005 | Tsuchjya et al. | 439/587 |
| 2007/0059967 | A1 * | 3/2007 | Itou | 439/345 |
| 2008/0318473 | A1 * | 12/2008 | Morikawa et al. | 439/588 |

* cited by examiner

*Primary Examiner*—Ross N Gushi
(74) *Attorney, Agent, or Firm*—Edwards Angell Palmer & Dodge LLP; Peter F. Corless

(57) ABSTRACT

The present invention features a power terminal for ABS connector. Preferably, the power terminal for ABS connector is inserted into and secured to an insertion pipe of a male connector for an ABS and has a conductive terminal body. The conductive terminal body has, at one end thereof, a mounting element for mounting a first waterproofing member and a first barrel for securing a power wire, guide projections, projectedly formed at a middle portion thereof, for guiding insertion of the conductive terminal body, and, at the other end thereof, a hook for maintaining an inserted state of the conductive terminal body using an elastic property thereof. The portion of the conductive terminal body that is positioned between the guide projections and the hook is lengthened, a second waterproofing member is mounted to the portion, and a second barrel for securing one end of the second waterproofing member is formed on the conductive terminal body.

15 Claims, 6 Drawing Sheets

[FIG. 1]
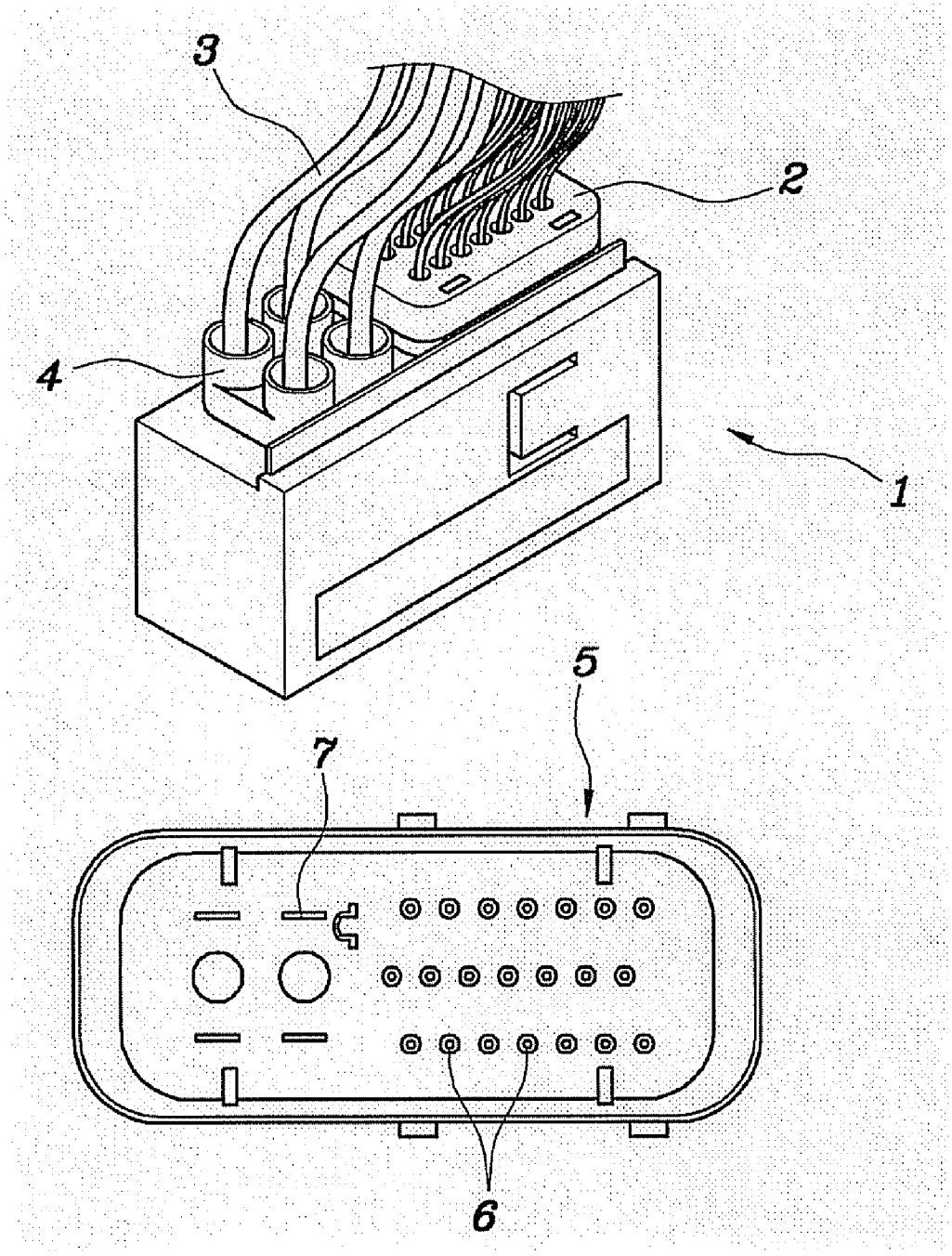
PRIOR ART

[FIG. 2]
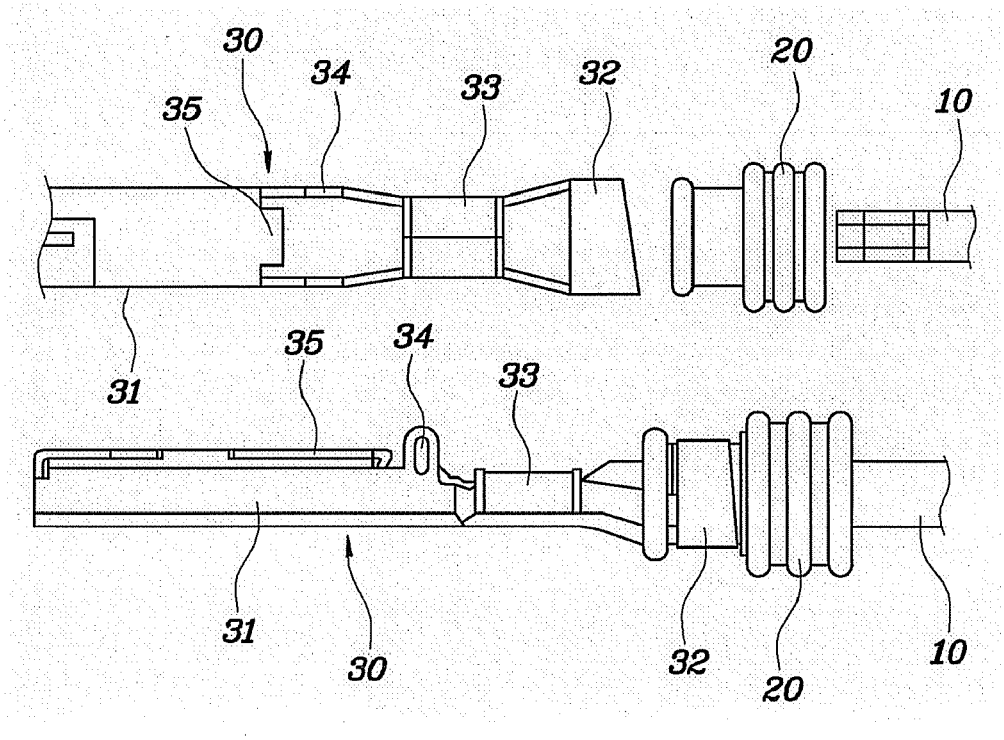
PRIOR ART

[FIG. 3]
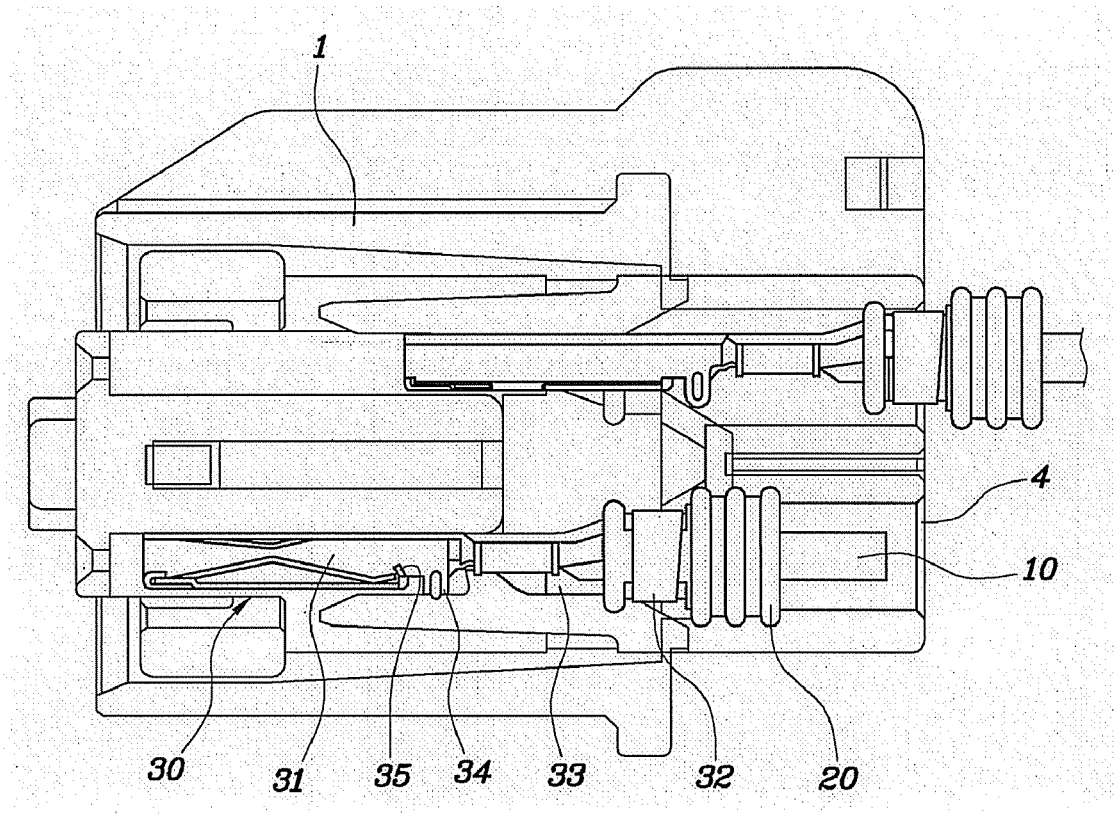
PRIOR ART

[FIG. 4]
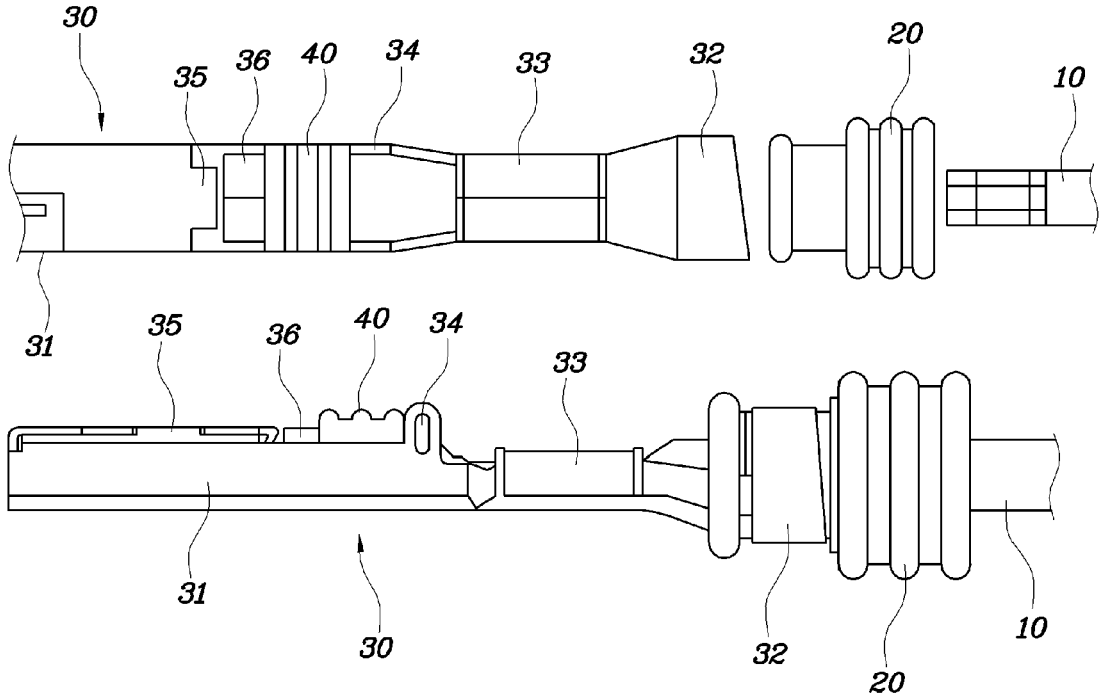

[FIG. 5]
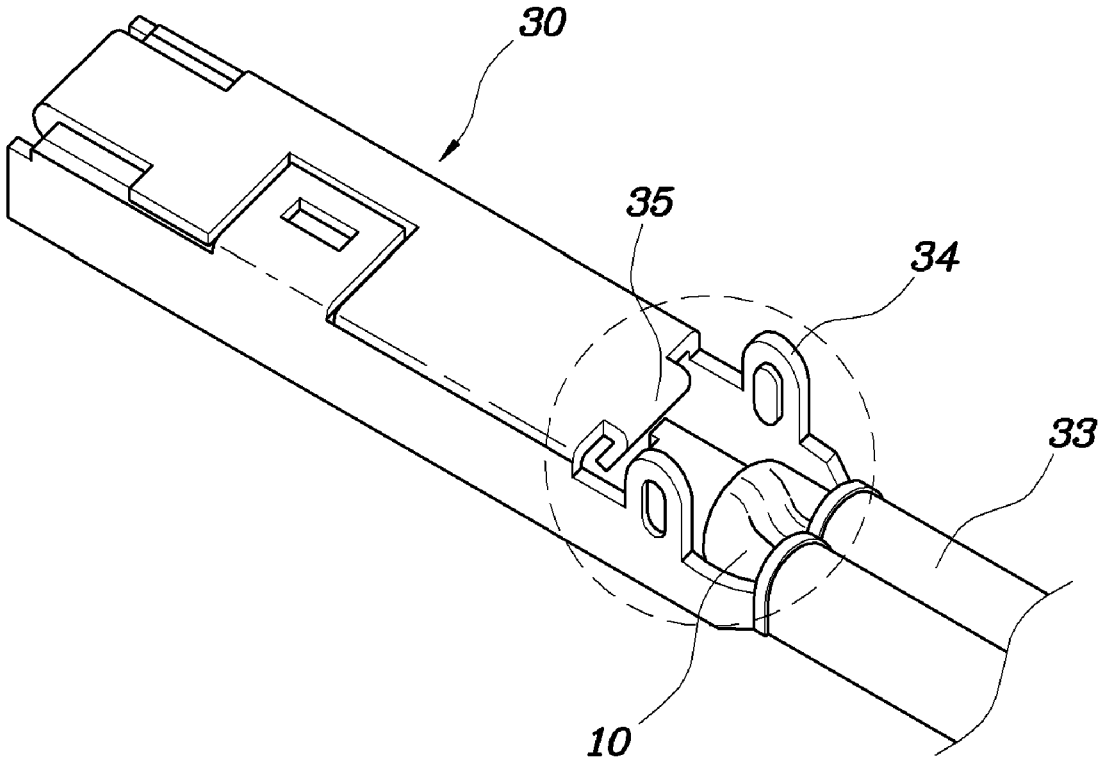

[FIG. 6]
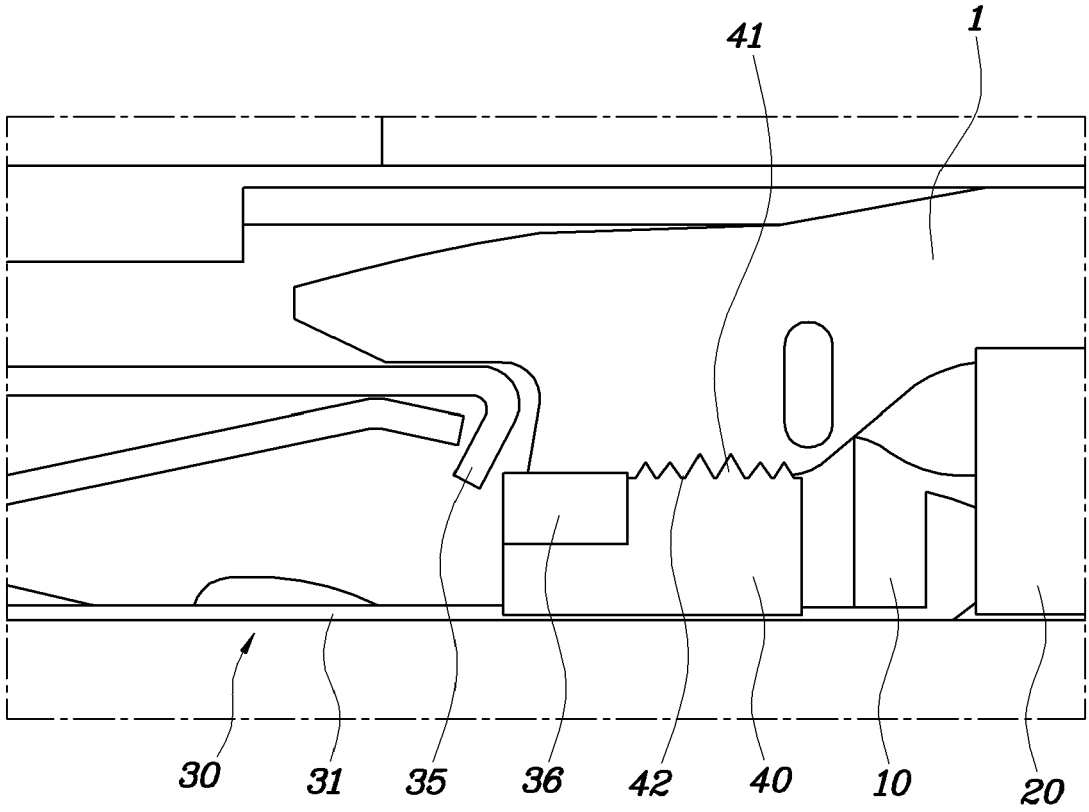

STRUCTURE OF POWER TERMINAL FOR ABS CONNECTOR

CROSS-REFERENCE TO RELATED APPLICATIONS

This application claims under 35 U.S.C. §119(a) priority to Korean Application No. 10-2007-0129240 filed on Dec. 12, 2007, the disclosure of which is incorporated herein by reference in its entirety.

BACKGROUND OF THE INVENTION

1. Field of the Invention

The present invention relates to a structure of a power terminal for an ABS (antilock brake system) connector and, more particularly, to a structure of a power terminal for an ABS connector, in which the configuration of the power terminal to be inserted into the ABS connector is modified so that the leakage of water through the power terminal can be effectively prevented.

2. Background Art

An ABS (antilock brake system) is a system for increasing the braking force for a vehicle by suitably preventing brakes from locking up. Generally, with ordinary brakes, the wheels may lock when braking hard, and so the wheels may skid, leading to a loss of steering control and/or lateral slipping. Accordingly, if a vehicle is equipped with ABS, since hydraulic pressure to the brakes is released and reapplied 7 or 8 times a second to effectively apply braking force to the wheels, the stopping distance may suitably decrease, even on wet or slick pavement, and it is possible to prevent the vehicle from slipping sideways, so that the danger of sudden stops can be considerably reduced.

Recently, corrosion, due to the leakage of water, of a connector that connects the harness of an ABS module has been observed, and, more seriously, short circuits leading to vehicle fires have been reported.

The structure of a harness connecting connector of an ABS module (hereinafter, referred to as an "ABS connector") and the leakage of water will be explained with reference to exemplary FIGS. 1 through 3.

An ABS connector is generally composed of a male connector 1 and a female connector 5. As shown in FIG. 1, various data lines 2 for controlling an ABS and four power lines 3 for suitably supplying power are connected to the male connector 1. Preferably, the four power lines 3 are composed of two positive power lines and two negative power lines. The four power lines 3 are installed in a manner such that the power terminals secured to the ends thereof are respectively inserted through insertion pipes 4 which are provided to the male connector 1.

Referring to FIG. 1, the female connector 5 is preferably provided with various connection terminals 6, which are connected with the data lines 2, and power terminals 7, which are connected with the four power lines 3. Accordingly, when the male and female connectors 1 and 5 are coupled with each other, if moisture leaks through the insertion pipes 4 of the male connector 1, the leaking moisture is likely to reach the power terminals 7 which are formed in the female connector 2, thereby causing corrosion, and can result in a short circuit, which can result in a vehicle fire, where the fire may occur in the power terminals 7.

FIG. 2 illustrates an exemplary structure of a power terminal 30 which is preferably secured to the power line 3 and is inserted through the insertion pipe 4 of the male connector 1. The power terminal 30, to which a power wire 10 is coupled along with a waterproofing member 20, preferably has a quadrangular conductive terminal body 31. A mounting element 32, into and to which the waterproofing member 20, comprising a rubber packing, is preferably inserted and secured, is provided to one end of the conductive terminal body 31. A barrel 33 for securing the power wire 10 is formed on the conductive terminal body 31 inward from the mounting element 32. After the waterproofing member 20 is inserted through and mounted to the mounting element 32 of the power terminal 30, the power wire 10 is inserted through the waterproofing member 20 and is secured by the barrel 33.

Guide projections 34 are projectedly formed on the middle portion of the conductive terminal body 31 to guide the insertion of the power terminal 30 into the insertion pipe 4 of the male connector 1. Preferably, a hook 35 is provided on the other end of the conductive terminal body 31 to lock the power terminal 30 in the insertion pipe 4 when the power terminal 30 is fully inserted into the insertion pipe 4.

FIG. 3 illustrates the state in which the power terminal, 30 preferably configured as described above, is inserted into the insertion pipe 4 of the male connector 1. The hook 35 is retracted into the conductive terminal body 31 by the elastic force of a spring or the like while the power terminal 30 is suitably inserted, and is extended out of the conductive terminal body 31 after the power terminal 30 is fully inserted, to serve as a latch, so that the power terminal 30 is prevented from being released outward.

In the conventional structure of the power terminal 30, since the waterproofing member 20 cannot satisfactorily perform a waterproofing function alone, the moisture leaked through the insertion pipe 4 is likely to reach the end of the power terminal 30 to cause a problem due to the occurrence of corrosion, a short circuit, etc. Further, if force for pulling the power terminal 30 is suitably applied with the hook 35 inadequately locked while a vehicle travels, the waterproofing member 20 is likely to be released from the male connector 1. Accordingly, the moisture reaching the insertion pipe 4 soaks to the power terminal 7 of the female connector 5, thus causing a considerable problem. The above information disclosed in this the Background section is only for enhancement of understanding of the background of the invention and therefore it may contain information that does not form the prior art that is already known in this country to a person of ordinary skill in the art.

SUMMARY OF THE INVENTION

The present invention preferably provides a structure of a power terminal for an ABS connector that has a double waterproofing scheme through the installation of a second waterproofing member at an optimal position while preserving the structure of a conventional power terminal, so that it is possible to effectively prevent moisture from leaking through an insertion pipe of a male connector.

In one preferred embodiment of the present invention, there is provided a structure of a power terminal for an ABS connector, the power terminal being suitably inserted into and secured to an insertion pipe of a male connector for an ABS and having a conductive terminal body which has, at one end thereof, a mounting element for mounting a first waterproofing member and a first barrel for securing a power wire inserted through the first waterproofing member, guide projections, projectedly formed at a middle portion thereof, for guiding insertion of the conductive terminal body, and, at the other end thereof, a hook for suitably maintaining an inserted state of the conductive terminal body by an elastic function thereof, wherein the portion of the conductive terminal body that is positioned between the guide projections and the hook is lengthened, a second waterproofing member is mounted to that portion, and a second barrel for securing one end of the second waterproofing member is formed on the conductive terminal body.

According to another preferred embodiment of the present invention, the portion of the conductive terminal body that is suitably positioned between the guide projections and the hook is suitably lengthened such that the length of the portion of the second waterproofing member that comes into tight contact with the inner surface of the insertion pipe of the male connector, is greater than 2 mm, 3 mm, 4 mm, 5 mm, 6 mm, 7 mm or more, preferably 5 mm.

According to still another embodiment of the present invention, a plurality of crests and valleys is suitably formed on the surface of the second waterproofing member such that crests positioned at the middle of the second waterproofing member are higher than crests positioned at both ends of the second waterproofing member.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a view illustrating a conventional ABS connector;

FIG. 2 is a view illustrating the structure of a conventional power terminal for an ABS connector;

FIG. 3 is a view illustrating the state in which the power terminal shown in FIG. 2 is inserted into a male connector;

FIG. 4 is a view illustrating the structure of a power terminal for an ABS connector in accordance with an embodiment of the present invention;

FIG. 5 is a view illustrating a portion between guide projections and a hook, which is to be extended according to the present invention; and FIG. 6 is a view illustrating the state in which the power terminal according to the present invention is inserted into a male connector.

DETAILED DESCRIPTION

As described herein, the present invention includes a structure of a power terminal for an ABS connector comprising the power terminal for an ABS connector being inserted into and secured to an insertion pipe of a male connector for an ABS, wherein the power terminal has a conductive terminal body at one end, a mounting element for mounting a first waterproofing member and a first barrel for securing a power wire, guide projections, and a hook for maintaining an inserted state of the conductive terminal body using an elastic property thereof, wherein a portion of the conductive terminal body that is positioned between the guide projections and the hook is lengthened, and a second waterproofing member is mounted to the portion of the conductive terminal body, and a second barrel for securing one end of the second waterproofing member is formed on the conductive terminal body.

In one embodiment, the mounting element and the first barrel are inserted through the first waterproofing member.

In another embodiment, the guide projections are for guiding insertion of the conductive terminal body. In a related embodiment, the guide projections are projectedly formed at a middle portion of the power terminal.

In another further embodiment, the hook is used for maintaining an inserted state of the conductive terminal body using an elastic property thereof. In a related embodiment, the hook is at the other end of the power terminal.

In another aspect, the invention features a structure of a power terminal for an ABS connector comprising a power terminal for an ABS connector being inserted into and secured to an insertion pipe of a male connector for an ABS, wherein the power terminal has a conductive terminal body at one end, a mounting element for mounting a first waterproofing member and a first barrel for securing a power wire inserted through the first waterproofing member, a guide projections, projectedly formed at a middle portion of the power terminal, for guiding insertion of the conductive terminal body, and a hook, at the other end of the power terminal, for maintaining an inserted state of the conductive terminal body using an elastic property thereof, wherein a portion of the conductive terminal body that is positioned between the guide projections and the hook is lengthened, and a second waterproofing member is mounted to the portion of the conductive terminal body, and a second barrel for securing one end of the second waterproofing member is formed on the conductive terminal body.

In another embodiment of any one of the above aspects, the portion of the conductive terminal body that is positioned between the guide projections and the hook is lengthened such that a length of a portion of the second waterproofing member that comes into tight contact with an inner surface of the insertion pipe of the male connector, is greater than 2 mm, 3 mm, 4 mm, 5 mm, 6 mm, 7 mm, 8 mm, preferably 5 mm.

In an other further embodiment, the portion of the conductive terminal body that is positioned between the guide projections and the hook is lengthened such that a length of a portion of the second waterproofing member that comes into tight contact with an inner surface of the insertion pipe of the male connector, is greater than 5 mm.

The invention can also include a motor vehicle comprising the power terminal for an ABS connector as described in any one of the aspects herein.

Reference will now be made in greater detail to preferred embodiments of the present invention, examples of which are illustrated in the accompanying drawings. Wherever possible, the same reference numerals will be used throughout the drawings and the description to refer to the same or like parts.

FIG. 4 is an exemplary view illustrating the structure of a power terminal for an ABS connector in accordance with preferred embodiments of the present invention, FIG. 5 is an exemplary view illustrating a portion between guide projections and a hook, which is to be suitably extended according to the present invention, and FIG. 6 is a view illustrating the state in which the power terminal according to the present invention is preferably inserted into a male connector.

Preferably, the structure of a power terminal for an ABS connector in accordance with exemplary embodiments of the present invention is suitably configured as described below so that it can be inserted into and secured to an insertion pipe of a male connector. Preferably, a mounting element 32 for securing a first waterproofing member 20 is suitably provided to one end of a conductive terminal body 31. A first barrel 33 for securing a power wire 10 inserted through the first waterproofing member 20 is preferably formed on the conductive terminal body 31 adjacent to that end thereof. In certain preferred embodiments, guide projections 34 are projectedly formed on the middle portion of the conductive terminal body 31 to guide the insertion of a power terminal 30. In other preferred embodiments, a hook 35 is provided to the other end of the conductive terminal body 31 to suitably maintain the inserted state of the power terminal 30 using the elastic property thereof. Preferably, this configuration of the power terminal 30 is the same as that of the conventional power terminal described with reference to FIG. 2.

According to the conventional structure of a power terminal, for example as described above, since the first waterproofing member 20 cannot satisfactorily perform a waterproofing function alone, the moisture leaking through the insertion pipe of a male connector is likely to reach the end of the power terminal 30.

In preferred embodiments of the present invention, a second waterproofing member 40 is preferably mounted at an optimal position on the conductive terminal body 31 of the power terminal 30, which suitably prevents leakage of moisture and related problems. According to preferred embodiments of the invention, the optimal position for mounting the second waterproofing member 40 is determined in consideration of the following factors.

In one preferred embodiment, because one end portion of the conductive terminal body 31 provided with the mounting element 32 and the first barrel 33 is preferably mounted with the power wire 10 and the first waterproofing member 20, the one end portion has a complicated shape, and has no suitable marginal space for mounting the second waterproofing member 40. In further related embodiments, when the second waterproofing member 40 can be mounted to the one end of the conductive terminal body 31, since the second waterproofing member 40 is positioned close to the first waterproofing member 20, the waterproofing effect may suffer.

In a further related embodiment, the other end portion of the conductive terminal body 31, provided with the hook 35, must have suitably sufficient length to ensure the elastic property of the hook 35. Moreover, since an engagement protrusion is preferably formed in the insertion pipe of an ordinary male connector so as to be engaged with the hook 35, if the length of the hook 35 is changed to form the second waterproofing member 40, the male connector itself must be suitably redesigned, in which case economy suffers.

In preferred embodiments of the present invention, in consideration of these factors, for example as shown in exemplary FIG. 4, the second waterproofing member 40 is preferably mounted to the middle portion of the conductive terminal body 31, that is, between the guide projections 34 and the hook 35. Accordingly, for example referring to FIG. 5, in the conventional structure of a power terminal, the portion between the guide projections 34 and the hook 35 (which is circled in the drawing) is not long enough to suitably permit the mounting of the second waterproofing member 40 and the formation of an element for securing the second waterproofing member 40. Preferably, in certain embodiments, in the present invention, the portion of the conductive terminal body 31 that is positioned between the guide projections 34 and the hook 35 is suitably lengthened, and the second waterproofing member 40 is mounted thereto. In further preferred embodiments, a second barrel 36 for securing one end of the second waterproofing member 40 is formed on the conductive terminal body 31 so that the second waterproofing member 40 can be suitably mounted to the conductive terminal body 31 at an optimal position.

As described above, if the length of the hook 35 varies, the shape of the male connector should be suitably changed. Thus, in certain preferred embodiments of the present invention, it is preferred that the portion of the conductive terminal body 31 that is positioned between the guide projections 34 and the hook 35 be suitably extended to thus have increased length.

In exemplary embodiments of the present invention, in order to allow the second waterproofing member 40 to perform a waterproofing function, the length of the portion of the second waterproofing member 40 that comes into tight contact with the inner surface of the insertion pipe of the male connector must be greater than 3 mm, 4 mm, 5 mm, 6 mm, preferably 5 mm. According to further embodiments, it is preferred that the portion of the conductive terminal body 31 that is positioned between the guide projections 34 and the hook 35 be suitably extended in consideration of the length of the second barrel 36 such that the second waterproofing member 40 can be brought into contact with the inner surface of the insertion pipe 4 of the male connector 1 in a length greater than 3 mm, 4 mm, 5 mm, 6 mm, preferably 5 mm. Accordingly, the actual extension length of the portion may suitably vary depending upon, for example, the specification of the power terminal 30, the size of the second waterproofing member 40, the length of the second barrel 36, etc.

Preferably, the second barrel 36 performs a function similar to that of the first barrel 33. The second barrel 36 is constituted by arc-shaped fastening pieces which respectively project from both sides of the conductive terminal body 31. Preferably, the second barrel 36 is used in a manner such that, after the second waterproofing member 40 is mounted to the conductive terminal body 31, the two fastening pieces are suitably bent to squeeze and fasten one end of the second waterproofing member 40.

According to preferred embodiments of the invention as described herein, the second waterproofing member 40 comprises a packing which is made of the same rubber material as the first waterproofing member 20, and is preferably mounted to the portion of the conductive terminal body 31 extending between the guide projections 34 and the hook 35. Further, in an effort to improve the waterproofing function, as shown in FIG. 6, the portion of the insertion pipe of the male connector 1, through which the second waterproofing member 40 is fitted, is preferably formed to have a diameter less than that of the portion of the insertion pipe of the male connector 1, through which the first waterproofing member 20 is fitted, so that the second waterproofing member 40 can be brought into even tighter contact with the inner surface of the insertion pipe of the male connector 1.

In other preferred embodiments, a plurality of crests 41 and valleys 42 is suitably formed on the surface of the second waterproofing member 40. In further preferred embodiments, it is preferred that, by forming the crests 41 positioned at the middle higher than the crests 41 positioned at both ends, the force required for inserting the second waterproofing member 40 can be suitably reduced, in which case it is possible to appropriately perform a waterproofing function.

In further preferred embodiments, once the power terminal according to the present invention configured as described above is preferably inserted into the insertion pipe of the male connector and is suitably locked by the hook, since it is doubly waterproofed by the first and second waterproofing members, it is possible to effectively prevent moisture from leaking in and reaching the female connector.

As exemplified in the above description, the structure of a power terminal for an ABS connector according to the present invention, suitably configured as described above, preferably provides advantages in that, since the structure adopts a double waterproofing scheme, it is possible to prevent moisture from leaking through the insertion pipe of a male connector. Accordingly, the corrosion of a power line due to the leakage of moisture into a connector and the occurrence of fires due to short-circuiting, which were noted above as problems plaguing the conventional art, can be suitably avoided.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A structure of a power terminal for an ABS connector, the power terminal being inserted into and secured to an insertion pipe of a male connector for an ABS and having a conductive terminal body which has, at one end thereof, a mounting element for mounting a first waterproofing member and a first barrel for securing a power wire inserted through the first waterproofing member, and guide projections, projectedly formed at a middle portion thereof, for guiding insertion of the conductive terminal body, and, at the other end thereof, a hook for maintaining an inserted state of the conductive terminal body using an elastic property thereof, wherein a portion of the conductive terminal body that is positioned between the guide projections and the hook is lengthened, a second waterproofing member is mounted to the portion, and a second barrel for securing one end of the second waterproofing member is formed on the conductive terminal body.

2. A motor vehicle comprising the power terminal for an ABS connector of claim 1.

3. The structure according to claim 1, wherein the portion of the conductive terminal body that is positioned between the guide projections and the hook is lengthened such that a length of a portion of the second waterproofing member that comes into tight contact with an inner surface of the insertion pipe of the male connector, is greater than 5 mm.

4. The structure according to claim 3, wherein a plurality of crests and valleys is formed on a surface of the second waterproofing member such that crests positioned at a middle of the second waterproofing member are higher than crests positioned at both ends of the second waterproofing member.

5. A structure of a power terminal for an ABS connector comprising:

the power terminal for an ABS connector being inserted into and secured to an insertion pipe of a male connector for an ABS, wherein the power terminal has a conductive terminal body at one end;

a mounting element for mounting a first waterproofing member and a first barrel for securing a power wire;

guide projections; and a hook for maintaining an inserted state of the conductive terminal body using an elastic property thereof, wherein a portion of the conductive terminal body that is positioned between the guide projections and the hook is lengthened, and a second waterproofing member is mounted to the portion of the conductive terminal body, and a second barrel for securing one end of the second waterproofing member is formed on the conductive terminal body.

6. The structure of a power terminal for an ABS connector of claim 5, wherein the mounting element and the first barrel are inserted through the first waterproofing member.

7. The structure of a power terminal for an ABS connector of claim 5, wherein the guide projections are for guiding insertion of the conductive terminal body.

8. The structure of a power terminal for an ABS connector of claim 5, wherein the guide projections are projectedly formed at a middle portion of the power terminal.

9. The structure of a power terminal for an ABS connector of claim 5, wherein the hook is used for maintaining an inserted state of the conductive terminal body using an elastic property thereof.

10. The structure of a power terminal for an ABS connector of claim 5, wherein the hook is at the other end of the power terminal from the conductive terminal body.

11. The structure according to claim 5, wherein the portion of the conductive terminal body that is positioned between the guide projections and the hook is lengthened such that a length of a portion of the second waterproofing member that comes into tight contact with an inner surface of the insertion pipe of the male connector, is greater than 5 mm.

12. A motor vehicle comprising the power terminal for an ABS connector of claim 5.

13. A structure of a power terminal for an ABS connector comprising:

a power terminal for an ABS connector being inserted into and secured to an insertion pipe of a male connector for an ABS, wherein the power terminal has a conductive terminal body at one end;

a mounting element for mounting a first waterproofing member and a first barrel for securing a power wire inserted through the first waterproofing member;

guide projections, projectedly formed at a middle portion of the power terminal, for guiding insertion of the conductive terminal body; and a hook, at the other end of the power terminal, for maintaining an inserted state of the conductive terminal body using an elastic property thereof, wherein a portion of the conductive terminal body that is positioned between the guide projections and the hook is lengthened, and a second waterproofing member is mounted to the portion of the conductive terminal body, and a second barrel for securing one end of the second waterproofing member is formed on the conductive terminal body.

14. The structure according to claim 13, wherein the portion of the conductive terminal body that is positioned between the guide projections and the hook is lengthened such that a length of a portion of the second waterproofing member that comes into tight contact with an inner surface of the insertion pipe of the male connector, is greater than 5 mm.

15. A motor vehicle comprising the power terminal for an ABS connector of claim 13.

* * * * *